US012607074B2

(12) United States Patent
Klein

(10) Patent No.: US 12,607,074 B2
(45) Date of Patent: Apr. 21, 2026

(54) TWO-CONDUCTOR SYSTEM FOR EARTH BORING ROD SECTIONS

(71) Applicant: TRACTO-TECHNIK GmbH & Co. KG, Lennestadt (DE)

(72) Inventor: Tobias Klein, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 74 days.

(21) Appl. No.: 18/492,335

(22) Filed: Oct. 23, 2023

(65) Prior Publication Data

US 2024/0240529 A1 Jul. 18, 2024

(30) Foreign Application Priority Data

Oct. 24, 2022 (DE) ..... 102022128041.1

(51) Int. Cl.
*E21B 17/02* (2006.01)
*E21B 47/13* (2012.01)

(52) U.S. Cl.
CPC ..... *E21B 17/028* (2013.01); *E21B 47/13* (2020.05)

(58) Field of Classification Search
CPC ..... E21B 17/028; E21B 47/13; E21B 17/0285
See application file for complete search history.

(56) References Cited

U.S. PATENT DOCUMENTS

| | | | | |
|---|---|---|---|---|
| 6,717,501 | B2 * | 4/2004 | Hall | H01R 13/533 336/15 |
| 2004/0004202 | A1 * | 1/2004 | Eguchi | F16K 1/303 251/149.5 |
| 2004/0149471 | A1 * | 8/2004 | Hall | F16L 15/009 174/21 R |
| 2004/0242044 | A1 * | 12/2004 | Head | E21B 17/0285 439/190 |
| 2006/0283606 | A1 | 12/2006 | Partouche et al. | |
| 2008/0166917 | A1 | 7/2008 | Hall et al. | |
| 2020/0088027 | A1 * | 3/2020 | Vannuffelen | G10K 11/002 |

FOREIGN PATENT DOCUMENTS

| | | | |
|---|---|---|---|
| DE | 1178384 | B | 9/1964 |
| DE | 102014005892 | A1 | 10/2015 |
| EP | 0860907 | A2 | 8/1998 |
| EP | 0909876 | A2 | 4/1999 |

* cited by examiner

*Primary Examiner* — Amine Benlagsir
(74) *Attorney, Agent, or Firm* — LEASON ELLIS LLP

(57) ABSTRACT

The invention relates to a two-conductor system for earth boring rod sections for forming a boring string for an earth boring device, wherein the two-conductor system has an insulated composite made of a first conductor and a second conductor, and the first and second conductors are each exposed at one end from the composite in a connection direction, and at least a section of an exposed end of one of the conductors is surrounded on the circumference by an inner and an outer insulation sleeve.

6 Claims, 4 Drawing Sheets

TWO-CONDUCTOR SYSTEM FOR EARTH BORING ROD SECTIONS

The invention relates to a two-conductor system for earth boring rod sections for forming a boring string for an earth boring device, an earth boring rod section having a two-conductor system, an earth boring rod section system, as well as a use when transmitting electrical signals and/or electrical current using a two-conductor system for earth boring rod sections for forming a boring string for an earth boring device.

In the case of rod-based boring in the earth by means of an earth boring device, in particular for producing so-called horizontal boreholes, a boring head is typically driven by means of a boring string by a drive device arranged on the Earth's surface or in a pit.

The boring strings used can have individual, interconnected earth boring rod sections, which—depending on the course of the boring—are gradually attached to the rear end of the already drilled boring string and connected thereto.

In order to supply electrical consumers and/or to transmit signals in the boring string, it may be necessary to provide electrical connections between the individual earth boring rod sections. Using a conductor or a cable that can be guided inside the earth boring rod section is known for this purpose.

A disadvantage of the otherwise previously well-functioning conductors in the earth boring rod sections can arise from a possible short circuit, especially if a boring fluid is used when boring or creating the earth borehole and more than one conductor is provided in the earth boring rod section.

Proceeding from this prior art, the invention is based on the object of providing a two-conductor system for earth boring rod sections for forming a boring string for an earth boring device, an earth boring rod section having a two-conductor system, an earth boring rod section system, as well as a use when transmitting electrical signals and/or electrical current using a two-conductor system for earth boring rod sections for forming a boring string for an earth boring device, using which it is possible to form and attach the connection of the earth boring rod sections with the fewest possible problems, in particular without the occurrence of a short circuit.

The object is achieved by the subject matter of the independent claims. Advantageous refinements of the subject matter of the independent claims are the subject matter of the respective dependent claims and result from the following description.

A first core concept of the invention is to create insulation for a two-conductor system, using which a better insulating effect of the multiple conductors among one another or in relation to one another is achieved, but wherein in addition the handling of the earth boring rod sections is retained, in particular when forming and also when disconnecting the connection of the earth boring rod sections to one another. The invention follows the initially paradoxical approach of not only providing one insulation sleeve around one of the conductors, but rather two insulation sleeves around the same conductor, which in particular have a different longitudinal extension along the one or the two conductors. The first core concept of the invention can alone provide patentability.

According to the first aspect, the invention relates to a two-conductor system for earth boring rod sections for forming a boring string for an earth boring device, wherein the two-conductor system has an insulated composite made of a first conductor and a second conductor, and the first and second conductors are each exposed at one end from the composite in a connection direction. At least one section of an exposed end of one of the conductors is circumferentially surrounded by an inner and an outer insulation sleeve. In this way, effective insulation of the one conductor can be created.

The term "two-conductor system" in the sense of the invention describes a system that can be arranged in an earth boring rod section, which in turn is designed to form a boring string for an earth boring device. The two-conductor system can have a length adapted to the earth boring rod section in which it is to be arranged. At each of the ends, the two-conductor system can be fixed in the earth boring rod section. The two-conductor system can be fixed in the earth boring rod section essentially in the middle of the earth boring rod section. The fixation in the end region of the two-conductor system in the earth boring rod section can preferably be done using centering stars.

A two-conductor system described herein can be used to "upgrade" an existing earth boring rod section so that a system in the shape of the two-conductor system can be arranged in the earth boring rod section, which allows multiple, i.e., at least two conductors to be used for the transmission of current and/or signals over at least one subsection of the boring string. The user of a rod-based earth boring device can be offered added value by means of the two-conductor system, for example: Units in the region of the boring head of the boring string can be supplied with power and/or signals. In particular, providing more than one conductor offers the user added value that should not be underestimated, since the two conductors are used independently of one another and are not limited in terms of their use for future tasks and/or units arranged on the boring head.

The term "conductor" in the sense of the description comprises an electrically conductive conductor. The term "two-conductor" in the sense of the description comprises a system in which there are at least two conductors. It can also be provided that there are exactly two conductors in the two-conductor system.

The term "earth boring rod section" in the sense of the description comprises individual, in particular rigid rod sections which are connectable directly or indirectly to one another and which can be connected to one another in the longitudinal axial direction to form a boring rod or a boring string. For connection to one another, the rod sections can be plugged or screwed together with the mechanical interconnection of an intermediate element or without the interconnection of an intermediate element. Mixed forms of plugging together and screwing together the earth boring rod sections are possible. The earth boring rod sections can in particular be connected by means of screwing together or plugging together one end of one earth boring rod section with another end of another earth boring rod section.

The term "boring string" as used in the description comprises multiple interconnected rod sections. The boring string can extend in the longitudinal axial direction along the longitudinal axis of the earth boring rod sections in a boring string axis which is substantially congruent or coincident with the longitudinal axes of the earth boring rod sections. At one end, in particular at the front end, the boring string can have a boring head and possibly a provided boring head tip, which can be designed as a boring tool (for example as an expanding head), or a region adjacent to the boring head, which in particular can have the same orientation as the boring head. The boring string can also have a sensor section or a sensor housing in which one or more sensors can be arranged, in the region of the boring head or a region adjacent to the boring head.

The term "earth boring device" in the sense of the description comprises one (and thus any) device which, in particular, can move a boring string having earth boring rod sections in a channel in the ground, which exists or is to be created, in order to create or widen a borehole, in particular a horizontal borehole (HD), or pull pipelines or other long bodies into the ground. The earth boring device can in particular be an HD device. An earth boring device can be a device that drives a boring string and that can work in particular by displacing the ground. The boring string can be translationally and/or rotationally introduced into the ground in the longitudinal axial direction of the boring string. The boring string can be moved in the ground by means of the earth boring device by applying tension or pressure.

The term "ground" in the sense of the description comprises any type of material, in particular earth, sand, rock, boulders, and/or stone, in which channels or boreholes, which are preferably horizontal at least in some sections, are either already present or have to be created. An underground arrangement of the ground is preferred, but not absolutely necessary.

In the meaning of the description, the term "insulated composite" comprises a first conductor and a second conductor, which can be handled together. The first conductor and the second conductor can be handled together as one element or in one piece. In this context, the term "insulated" expresses that the two conductors are in a composite in such a way that there is external insulation. The first and second conductors are surrounded by insulation which is arranged circumferentially around the first and/or the second conductor.

The term "connection direction" in the sense of the description comprises a direction which indicates that there is a connection in the longitudinal axial direction of the two-conductor system that leads away from the two-conductor system or the first and/or second conductor, in the longitudinal axial direction of the two-conductor system.

If the two-conductor system is arranged in the earth boring rod section, then the connection direction points out of the end or the ends of the earth boring rod section. One of the conductors can be surrounded at least in sections on the circumference by both the inner and the outer insulation sleeve. In one section, both the inner and outer insulation sleeves can surround the one conductor. It can be provided that one of the insulation sleeves, in particular the outer insulation sleeve, projects beyond the other insulation sleeve, in particular the inner insulation sleeve. A projection in the longitudinal axial direction can be present in a direction away from the two-conductor system and/or in the direction of the two-conductor system. It can be provided that one of the two insulation sleeves, in particular the outer insulation sleeve, surrounds the other insulation sleeve, in particular the inner insulation sleeve, in particular in a clamp-like manner, with respect to the longitudinal axis of the insulation sleeve(s) or of the two-conductor system. One of the insulation sleeves, in particular the outer insulation sleeve, can have a length that is at least 1.5 times, in particular at least 2 times, longer than the other insulation sleeve.

In a further, second aspect, the invention follows the core concept, which in itself is patent-worthy, of providing a design so that at least a section of an electrical conduction path is designed differently than in the prior art. There is a section formed in the direction of the two-conductor system, which adjoins the exposed end of one of the conductors. A break has been made from the previous consideration that the conduction path, starting from the exposed end of the one conductor, has to be formed in an essentially straight manner and directed forward, thus directed essentially away from the conductor. It has been recognized that in order to reduce short circuits among the conductors, an electrical conduction path can be provided which has at least one section which is led from an exposed end of the one conductor of the two-conductor system in a direction that is directed away from the adjacent end of the two-conductor system, back in the direction of the two-conductor system. The electrical conduction path, by means of which the exposed end of one conductor can be connected directly or indirectly to a conductor of another two-conductor system, has a section which is between the exposed end of the one conductor and a conductor of another two-conductor system. The section leads away from the exposed end and the end of the two-conductor system adjacent to the exposed end, namely in the opposite direction when viewed in the longitudinal axial direction. The electrical conduction path can have a component directed "backward", which includes a section that is returned via a section of the conductor, the exposed end of which is in electrical contact with the electrical conduction path. By designing the electrical conduction path, which is led away from the exposed end (and the end of the two-conductor system adjacent to the exposed end) in the direction of a central region in terms of the longitudinal extension of the two-conductor system, sections of the conduction path of the one conductor can be arranged "one over another" in the radial direction. Two of the sections of the one conductor or its electrical conduction path arranged "one over another" or substantially parallel can be arranged spaced apart from one another by means of insulation (which can also be the insulation of the composite). The possibility can be created of separating the two conductors in the earth boring rod section from one another in such a way that a short circuit in particular is largely prevented. Preventing short circuits of the two conductors can largely be effectively prevented.

According to the second aspect, the invention provides a two-conductor system for earth boring rod sections for forming a boring string for an earth boring device, in which the two-conductor system has an insulated composite made of a first conductor and a second conductor. The first and the second conductor are each exposed at one end from the composite in a connection direction. An electrical conduction path is formed for at least one of the conductors, which extends away from the exposed end of the one conductor via the insulation of the one conductor and/or the composite counter to the connection direction and leads from there in the connection direction insulated past the one end of the one conductor. In this way, the second aspect of the invention can be taken into consideration, that of effectively preventing short circuits.

The two aspects with respect to the two-conductor system can be freely combined with one another. There is no difficulty in providing an inner and an outer insulation sleeve together with the described electrical conduction path. The two aspects can complement each other.

The term "exposed" in the sense of the description comprises a design in which access to the conductor is possible, in particular in the radial direction or at its circumference. The term "exposed" thus comprises a design in which there is no insulation circumferentially in the exposed region or end on the conductor.

The term "electrical conduction path" in the sense of the description comprises a formation of an electrically conductive section or path along which a current or a signal can be conducted. The electrical conduction path of the at least one conductor or the electrical conduction path starting for the at least one conductor from its exposed end can be selected such that a section of the conduction path is formed by means of insulation of the one conductor and/or the composite spaced apart from the one conductor, which is formed "adjacent", "above", or "below" the conductor with respect to a radial direction.

Based on the connection direction, a section of the electrical conduction path will be formed that is directed counter to the connection direction.

The design of the described "electric conduction path" is based on the approach of forming an "extended" conduction path in relation to the case previously in the prior art. However, the "extension" of the electrical conduction path of the one conductor can result in an improvement in the short-circuit behavior, particularly when using a boring liquid or a boring fluid that is fed through the earth boring rod sections.

In a preferred embodiment, the composite comprises a coaxial cable and the two conductors are the inner and outer conductors of the coaxial cable. This allows a particularly simple design of a component of the two-conductor system to be achieved. Coaxial cables are easy to handle and use.

In a preferred embodiment, the exposed end of the one conductor is contacted by means of an electrically conductive ring abutting the exposed end, by means of which the insulation of the one conductor and/or the composite is sealed off by pressing an insulating sealing piece onto the insulation of the one conductor and/or the composite.

The above-mentioned design can ensure that, on the one hand, a simple type of contacting is possible, but on the other hand, the integrity of the composite and/or the insulation of the conductor can also be largely ensured. The ring can be used not only to provide a part of the electrical conduction path, but also to maintain the integrity of the insulated composite even in the presence of pressurized boring fluid. With the pressurized boring fluid, in the absence of a seal, the case could occur in which the boring fluid reaches the region of the exposed end of the conductor "under" the insulation of the one conductor and the insulation could detach in the long term. A synergistic effect can be achieved in that the electrically conductive ring can provide both the electrical formation of the electrical conduction path and the integrity of the insulation of the one conductor or the composite.

In a preferred embodiment, the ring can be screwed over or into a counterpart which surrounds the insulation of the one conductor and/or the composite adjacent to the outer surface of the composite. The insulating sealing piece can be pressed together with the ring having an axial directional component onto the insulation of the one conductor and/or the composite during the screwing together. In this way, a simply designed connection that is easy to construct and plan can be created, which can only require the ring and the counterpart to be screwed together.

In a preferred embodiment, a front section of the ring is surrounded in the connection direction by an insulation sleeve, in particular the outer insulation sleeve. It is possible for an insulation sleeve, in particular the outer insulation sleeve, to shield the ring in a direction which corresponds to the connection direction and is commonly designated as "forward" (away from the two-conductor system), in order to create a "distance" between the conductors or the electrical conduction path formed from the one conductor to the other conductor or its exposed end. The insulation sleeve can assist the effect of the formation of the "backward directed" electrical conduction path as one of possibly multiple elements.

In a preferred embodiment, an electrically conductive connecting sleeve surrounds an insulation sleeve, in particular the outer insulation sleeve, at least in sections, and extends at least partially over the ring and/or the counterpart. A section of the electrical conduction path provided in the connection direction can be created by means of the electrically conductive connecting sleeve, which leads into the back/rear region (in the central region of the two-conductor system), into which the electrical conduction path is initially formed from the exposed end of the one conductor. The electrical conduction path, which was initially led backward from the exposed end, i.e., counter to the connection direction, can be led forward again, i.e., in the connection direction, by means of the connecting sleeve.

By means of the electrically conductive connecting sleeve, an element that is easy to handle, construct, and use is provided. A simple plug connection can also be used. The connecting sleeve can be pushed over the ring and/or the counterpart of the ring.

In a preferred embodiment, the two-conductor system for earth boring rod sections for forming a boring string for an earth boring device comprises a pressure relief valve for discharging excess pressure from the region of the two-conductor system. This makes it possible to keep a pressure in the region of the two-conductor system below or essentially equal to or slightly higher than a pressure level outside the two-conductor system.

Advantageously, excessive overpressure in the region of the two-conductor system can be largely prevented. Excessive overpressure could, for example, result in liquid from the region of the two-conductor system reaching the electrical first or second conductor(s), which could result in a short circuit.

Providing a pressure relief valve initially seems absurd without the knowledge gained from the invention, since the pressure relief valve fundamentally has to provide an opening via which the overpressure can be dissipated. However, such an opening should generally be avoided by those skilled in the art, since the opening itself can provide a source of danger for liquid or dirt to enter the region of the two-conductor system. It is the merit of the invention to have recognized that an advantage can be achieved at all by a directed opening.

The term "pressure relief valve for discharging excess pressure" means any valve that can respond to or open when the pressure in the two-conductor system rises above a response pressure. The response pressure can essentially be understood as the pressure that corresponds to above the pressure of the surroundings of the boring string outside. It is understood that due to the sealing effect to be ensured in the pressure relief valve, which requires a restoring or pre-tensioned effect between the closure or shut-off body and the sealing surface or valve seat, the excess pressure at which the pressure relief valve responds can be slightly higher than the ambient pressure.

The term "region of the two-conductor system" is to be understood as a region that is provided to connect a first and/or a second electrical conductor of the two-conductor system to a corresponding first and/or second electrical conductor of the two-conductor system.

The invention also provides an earth boring rod section having a two-conductor system. The two-conductor system is arranged, in particular by means of at least one centering star, essentially centrally in the earth boring rod section in a cavity extending along the longitudinal axis of the earth boring rod section. The earth boring rod sections can be pre-assembled with the two-conductor system described. The arrangement by means of at least one centering star, wherein a centering star can be provided at each end of the earth boring rod section, also allows simple maintenance and/or simple replacement in the event of wear.

The invention also provides an earth boring pipe section system having multiple earth boring rod sections which have a two-conductor system, wherein the earth boring rod sections are connectable to one another to form a section of a boring string.

On at least one earth boring rod section or preferably on all earth boring rod sections of the earth boring pipe system, at least one or more pressure relief valve(s) can be formed on at least one end, preferably on exactly one end. The one or more pressure relief valves can be designed and arranged in such a way as to prevent excess pressure in relation to the ambient pressure of the boring string in the cavity of the earth boring rod section or in the region of the two-conductor system. At least one pressure relief valve at one end of the earth boring rod section can be sufficient to discharge excess pressure when two earth boring rod sections are connected. In particular, the excess pressure that can arise when two earth boring rod sections are connected to one another can be discharged.

The pressure relief valve can be formed as one or more closable opening(s) in an earth boring rod section, which can connect the cavity in which the two-conductor system is arranged to the surroundings of the boring string. The openings can extend as closable through openings from the region of the two-conductor system intended for the connection or the cavity to the outside.

An earth boring rod section can have at least one channel in its wall to form a pressure relief valve, which can have any design with regard to its direction and cross-sectional shape. Multiple channels can also be provided to form a pressure relief valve.

A straight design of a channel can be advantageous for simple production. A straight design transverse to the longitudinal axis of the earth boring rod section can be preferred in order to enable the shortest possible design of the channel and/or to simplify production and/or to achieve the least possible weakening of the integrity of the earth boring rod section. A curved and/or straight design of the channel at any angle to the longitudinal axis of the earth boring rod section is not excluded.

A round, in particular circular, cross-sectional shape of the channel can simplify production, since the channel can be created as a borehole, for example. A design other than a round cross-sectional shape is not excluded; in particular, a straight design of the cross-sectional shape at least in sections is possible.

It can be provided that the opening or the channel has a (closing) closure which acts in a direction counter to excess pressure in the cavity or the region of the two-conductor system, and which can, for example, be designed in the form of a flap. For example, the opening or the channel can have an elastic or movable flap-shaped design of a closure, which can at least partially abut the opening or the channel wall and can be pre-tensioned against the opening or the channel wall. If the pressure in the cavity or in the region of the two-conductor system increases, the closure can lift off from the opening or the channel wall and, after a pressure reduction, return back to the position abutting the opening or the channel wall.

It can be provided that the one or more closable opening(s) or the one channel or the multiple channels open into a groove on the earth boring rod section, wherein an O-ring can be arranged in the groove in order to close the opening(s) or the channel or channels.

It can also be provided that the openings or channels open into different grooves, each of which can have an O-ring. A groove having an O-ring can simplify production and planning. If excess pressure occurs, the O-ring can briefly (minimally) lift to dissipate the excess pressure and, once the pressure has been reduced, can close the opening again in the groove resting on the opening.

Alternatively or additionally, a pressure relief valve can be formed in that one or more U-rings are provided, which surround an earth boring rod section on the circumference and seal with a further earth boring rod section (connected to the one earth boring rod section).

Such U-rings are known in the field of hydraulic cylinders and enable pressure dissipation in one direction, while sealing is provided in the other direction. If the earth boring rod sections are connected, any pressure build-up thus resulting can be dissipated. If increased pressure from outside acts on the connection point with the U-ring(s), the U-ring(s) seal(s).

A simple connection of an end connection of the earth boring rod sections can be provided, which can be designed as a plug and/or screw connection. The ends of the earth boring rod sections and the ends of the two-conductor system arranged therein can be aligned in such a way that a positively guided connection of the ends of the two-conductor system occurs when the ends of two earth boring rod sections are connected. For example, the earth boring rod sections can be screwed together, and during the screwing process the two ends of the two-conductor system can be brought into plug-in contact with one another.

The two-conductor system is arranged, in particular by means of at least one centering star, essentially centrally in the earth boring rod section in a cavity extending along the longitudinal axis of the earth boring rod section. The earth boring rod sections can be pre-assembled with the two-conductor system described. The arrangement by means of at least one centering star, wherein preferably a centering star can be provided at each end of the earth boring rod section, also allows simple maintenance and/or simple replacement in the event of wear.

In a particularly preferred embodiment, an electrical conduction path or a section thereof, in particular in relation to the electrical conduction path, which is described for one of the conductors of the section described in the description and which has a "backwards guided or directed" section, may be formed via the connection of the two earth boring rod sections to one another. There can therefore be a section of an electrical conduction path via the connection of the earth boring rod sections to one another. Since the outer housing of the earth boring rod section has an electrically conductive material, such a design can be suitable since it does not require any additional elements that have to be provided.

A section of an electrical conduction path for at least one of the conductors can lead to a centering star, comprising an electrically conductive material, which is in electrically conductive contact with the housing of the earth boring rod section. A section of the electrical conduction path can be led for at least one of the conductors via the connection of the two earth boring rod sections and can be led from the centering star of the further earth boring rod section back into the conductor of the insulated composite of the further earth boring rod section.

Alternatively or additionally, it is possible for the centering stars to be directly connected to one another and for forming a section of the electrical conduction path via the housing of the earth boring rod sections to be dispensed with. A contact mechanism can be provided which electrically connects adjacent end centering stars to one another when a connection is formed between earth boring rod sections. For example, an electrically conductive element extending in the longitudinal direction of the earth boring rod section can be provided on one of the centering stars, which, when the connection of the two earth boring rod sections is formed, contacts the other centering star, which is also made electrically conductive.

According to the first aspect of the invention, the invention also provides a use in transmitting electrical signals and/or electrical power using a two-conductor system for earth boring rod sections for forming a boring string for an earth boring device. The two-conductor system has an insulated composite made of a first conductor and a second conductor. The first and the second conductor are each exposed at one end from the composite in a connection direction. An inner and an outer insulation sleeve is used to circumferentially insulate at least one section of an exposed end of one of the conductors.

According to the second aspect of the invention, the invention also provides a use in transmitting electrical signals and/or electrical power using a two-conductor system for earth boring rod sections for forming a boring string for an earth boring device, wherein the two-conductor system has an insulated composite made of a first conductor and a second conductor. The first and the second conductor are each exposed at one end from the composite in a connection direction. An electrical power path is used for at least one of the conductors, which extends from the exposed end of the one conductor away over the insulation of the one conductor and/or of the composite counter to the connection direction. From there, the electrical conduction path is led past the end of the one conductor in an insulated manner in the connection direction.

The ordinal numbers used in the description and the claims do not represent a preference, a specific ranking, or an ordered series, rather the ordinal numbers are used to identify or distinguish the elements provided with the ordinal numbers.

If statements are made in the description for the two-conductor system and/or for the earth boring rod section, the statements regarding the two devices, namely the two-conductor system and the earth boring rod section as well as the earth boring rod system, are also considered to be a disclosure for the use described in the description when transmitting electrical signals and/or electrical current. If the devices are based on device-side features, this also means with regard to a description that method features, method steps or features with regard to use describing the device-side features are disclosed.

The above statements, like the following description of exemplary embodiments, do not represent an omission of specific embodiments or features.

In the following, the invention will be explained in greater detail with reference to an exemplary embodiment illustrated in drawings.

IN THE DRAWINGS

Figure 1:
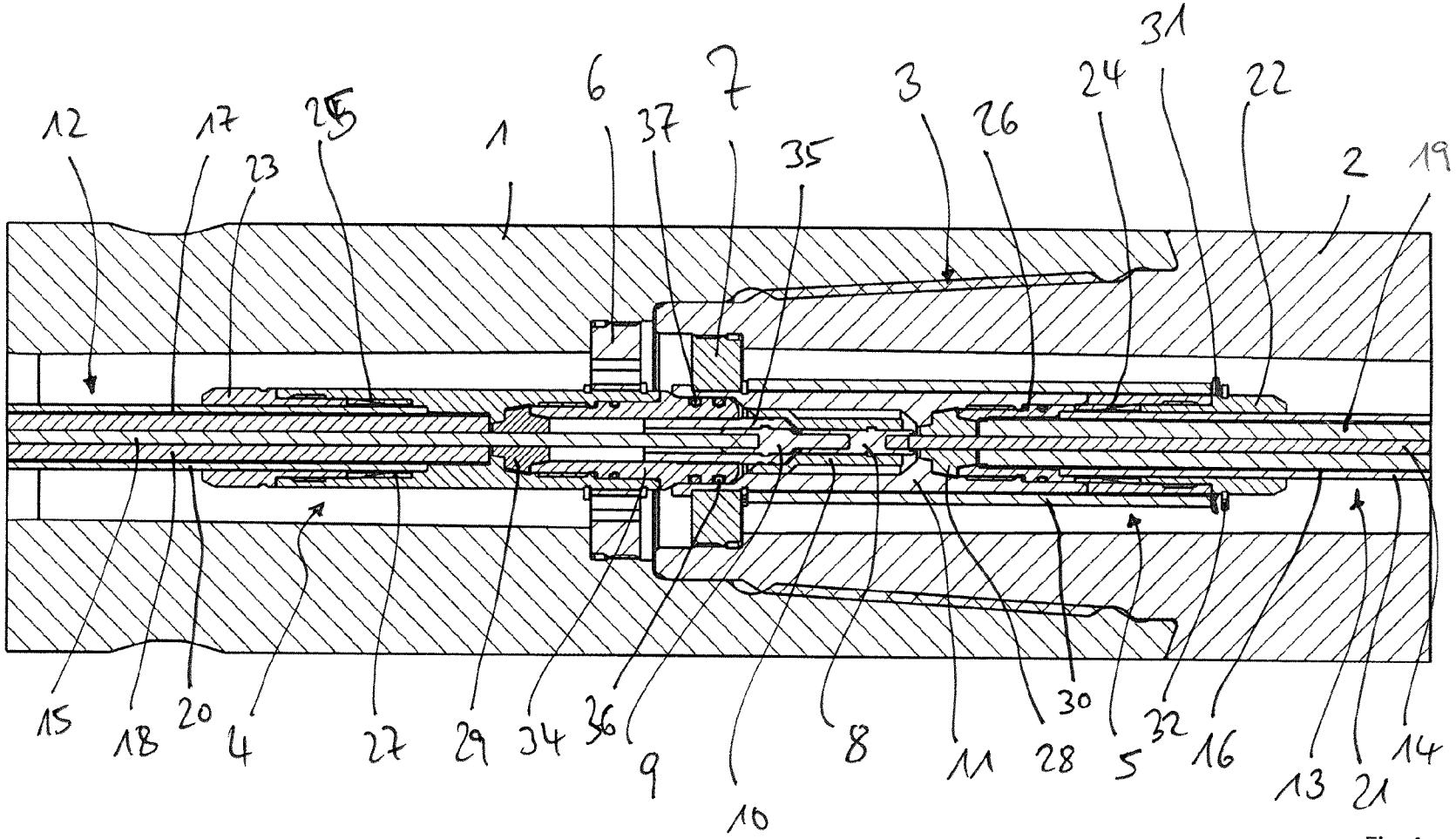
FIG. 1 shows a sectional view of a connection region of two rod sections of a boring string, wherein a two-conductor system is arranged in each of the two rod sections.
Figure 2:
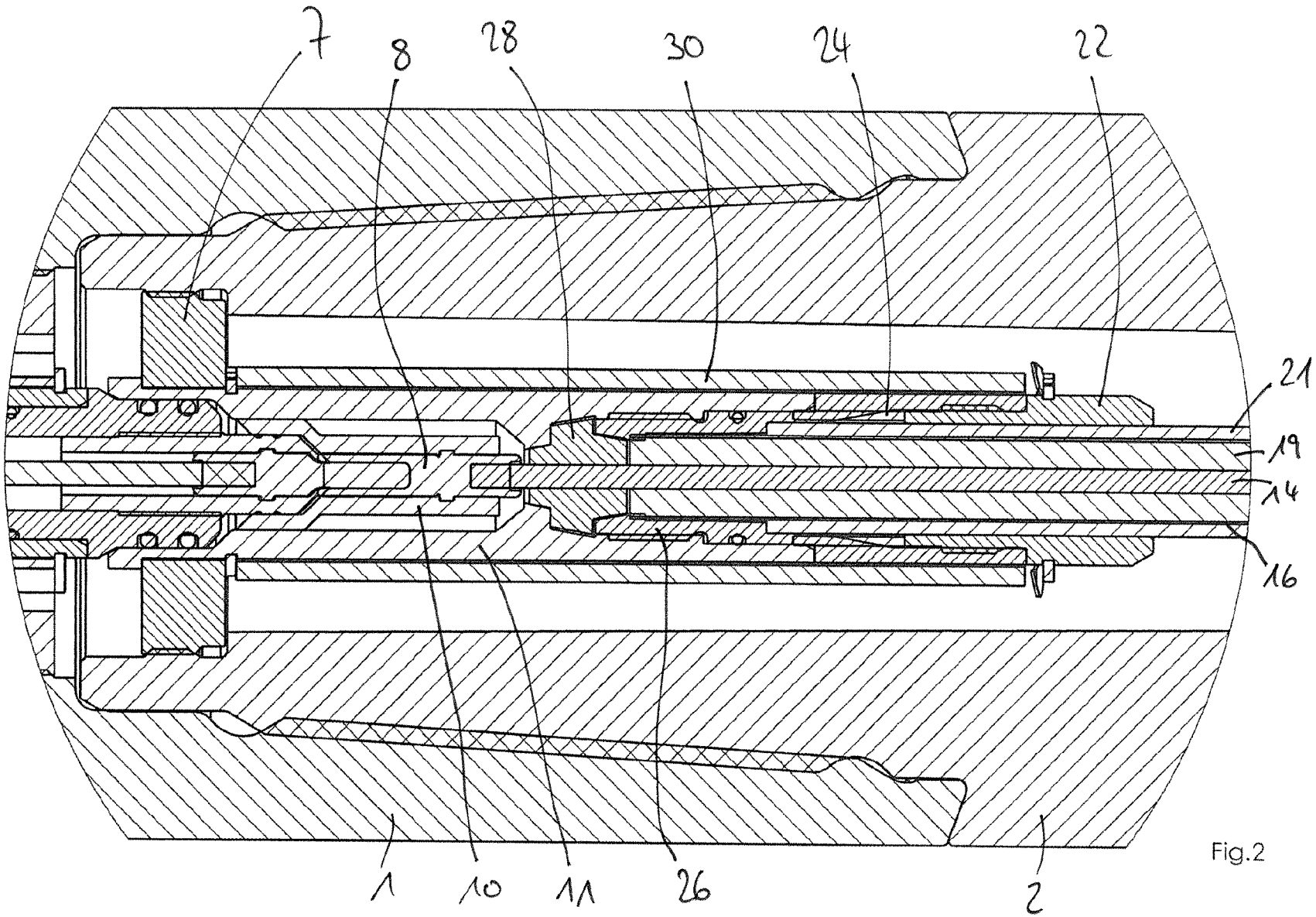
FIG. 2 shows an enlarged view of FIG. 1.
Figure 3:
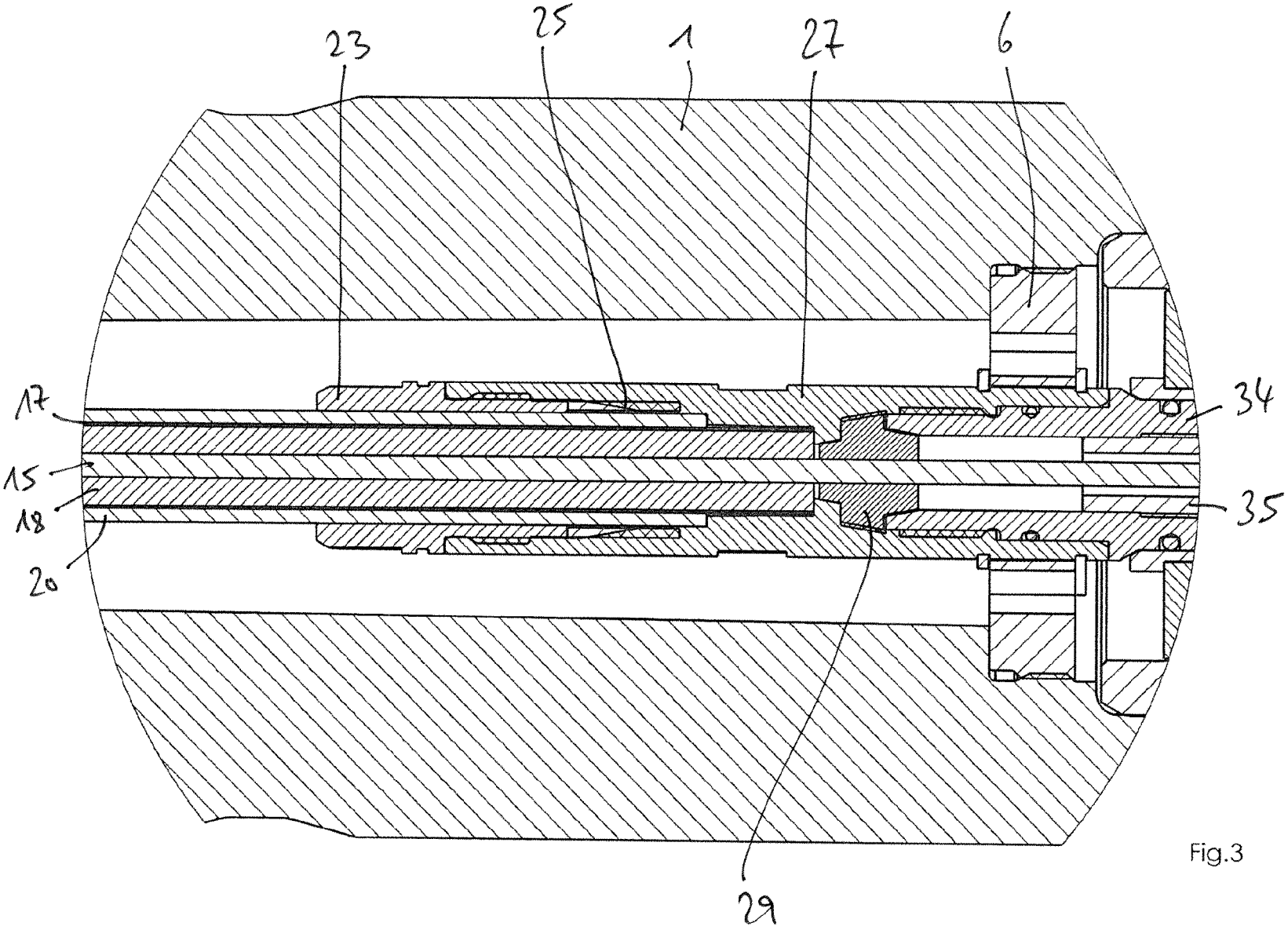
FIG. 3 shows an enlarged view of FIG. 1.

FIG. 1 shows a sectional view of a connection region between two rod sections 1, 2 for introducing a borehole into the ground. The rod sections 1, 2 are screwed together by means of a screw connection 3.

Each rod section 1, 2 has a two-conductor system 4, 5, which is arranged essentially centered in the cavity of the respective rod section 1, 2. The two-conductor system 4, 5 of a rod section 1, 2 is fixed by means of centering stars 6, 7, which are each inserted at the end at one of the ends of the rod sections 1, 2.

The two-conductor system 4, 5 has a composite having two conductors 15, 17 or 14, 16, wherein insulation 18 and 19 is present between the conductors 15, 17 and 14, 16, respectively. The conductor 17 or 16 surrounds the conductor 15 or 14 and there is further insulation 20 or 21 around the conductor 17 or 16. The two-conductor systems 4, 5 each have a coaxial cable 12, 13.

The two-conductor system 5 of the rod section 2 on the right in FIG. 1 has a socket 8 at the end, by means of which the inner conductor 14 of the coaxial cable 13 can be connected to the inner conductor 15 of the coaxial cable 12. The inner conductor 15 of the coaxial cable 12 has a plug 9 at the end, which is plugged in a positively-guided manner into the socket 8 of the rod section 1 on the right in FIG. 1 when the rod sections 1, 2 are screwed together.

Two insulation sleeves 10, 11 of the two-conductor system 5 are arranged around the socket 8, of which the insulation sleeve 10 is present within the outer insulation sleeve 11. The insulation sleeve 10 forms an inner insulation sleeve, while the insulation sleeve 11 forms an outer insulation sleeve. The insulation sleeve 10 protrudes from the socket 8 and the insulation sleeve 11 engages over the insulation sleeve 10.

The conductor 16 and the conductor 14 of the two-conductor system 5 as well as the conductor 15 and the conductor 17 are stripped of insulation in the region of the end of the two-conductor system 5 and 4 and are exposed without insulation 19, 21 and 18, 20.

A counterpart 22, 23 is pushed onto the insulation 21, 20. Furthermore, an insulating sealing piece 24, 25 is pushed on. A ring 26, 27 cooperating with the counterpart 22, 23 is connected to the counterpart 22, 23 by being screwed together, wherein the insulating sealing piece 24, 25 presses and seals itself via a cone between the counterpart 22, 23 and the insulation 21, 20. Ring 26, 27 and counterpart 22, 23 are made electrically conductive.

The inner conductors 14 and 15 are surrounded on the circumference in the front region by insulation 28, 29. The conductor 14 is compressed at the end with the socket 8, while the conductor 15 is compressed with the plug 9.

By means of the ring 26 and the counterpart 22, an electrical conduction path is formed, which is directed "backwards" and is guided via the insulation 21 via the conductor 14.

From the counterpart 22, the electrical conduction path is guided again in the connection direction by means of an electrically conductive connecting sleeve 30. A wave spring 31 and a locking ring 32 are provided to hold the electrically conductive connecting sleeve 30 in position.

The centering star 7 is in electrically conductive contact with the electrically conductive connecting sleeve 30. In the exemplary embodiment shown, the centering star 7 is electrically in contact with the rod section 2, which is in electrically conductive contact with the rod section 1. An electrical connection to the conductor 17 takes place via the centering star 6. The further electrical conduction path leads via the counterpart 23 having the ring 27, 33.

An inner insulation sleeve 35 and an outer insulation sleeve 34 are arranged over the conductor 15, which are present in the front region. The inner insulation sleeve 35 engages in a sealing manner in a projection of the inner insulation sleeve 10. The outer insulation sleeve 34 engages in a projection of the outer insulation sleeve 11 to form a seal using seals 36, 37. A tightness of 150 bar can be achieved.

Figure 4:
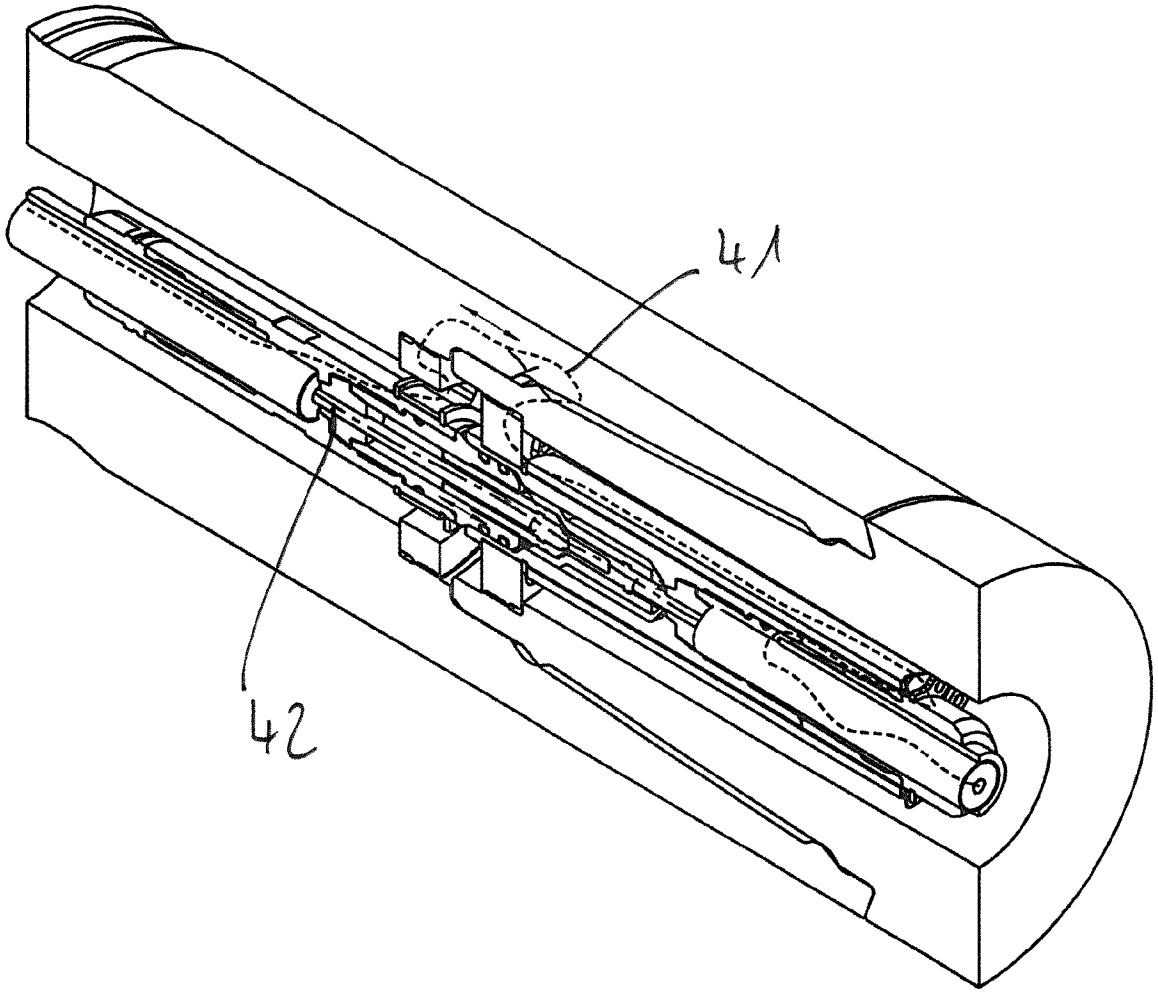
FIG. 4 shows an electrical conduction path.

FIG. 4 shows electrical conduction paths with dashed lines 41, 42 without reference numbers.

The invention claimed is:

1. A two-conductor system for earth boring rod sections for forming a boring string for an earth boring device, wherein the two-conductor system comprising:

an insulated composite made of a first conductor and a second conductor, and the first and second conductors are exposed at one end of the first conductor and at one end of the second conductor from the insulated composite in a connection direction, wherein an electrical conduction path is formed for at least the first and second conductors, the electrical conduction path extends away from the exposed at the one end of the first conductor via an insulation surrounding the first conductor and/or the insulated composite against the connection direction, and the electrical conduction path leads past the one end of the first conductor in an insulated manner in the connection direction, wherein the exposed at the one end of the first conductor is contacted by an electrically conductive ring abutting the exposed at the one end of the first conductor, by which the insulation surrounding the first conductor and/or the insulated composite is sealed by pressing an insulating sealing piece onto the insulation surrounding of the first conductor and/or the composite.

2. The two-conductor system according to claim 1, wherein the ring is screwed over or into a counterpart which surrounds the insulation surrounding the first conductor and/or the composite adjacent to an outer surface of the composite, and the insulating sealing piece together with the ring is pressed with an axial directional component onto the insulation surrounding the first conductor and/or the composite.

3. The two-conductor system according to claim 2, wherein an electrically conductive connecting sleeve surrounds an insulation sleeve and extends over the ring and/or the counterpart.

4. The two-conductor system according to claim 1, wherein a front section of the ring is surrounded by an insulation sleeve in the connection direction.

5. An earth boring rod section comprising a two-conductor system, wherein the two-conductor system comprising:

an insulated composite made of a first conductor and a second conductor, and the first and second conductors are exposed at one end of the first conductor and at one end of the second conductor from the insulated composite in a connection direction, wherein an electrical conduction path is formed for at least the first and second conductors, the electrical conduction path extends away from the exposed at the one end of the first conductor via an insulation surrounding the first conductor and/or the insulated composite against the connection direction, and the electrical conduction path leads past the one end of the first conductor in an insulated manner in the connection direction, wherein the exposed at the one end of the first conductor is contacted by an electrically conductive ring abutting the exposed at the one end of the first conductor, by which the insulation surrounding the first conductor and/or the insulated composite is sealed by pressing an insulating sealing piece onto the insulation surrounding of the first conductor and/or the composite.

6. An earth boring rod system comprising an earth boring rod section, and the earth boring rod section comprising a two-conductor system, wherein the two-conductor system comprising:

an insulated composite made of a first conductor and a second conductor, and the first and second conductors are exposed at one end of the first conductor and at one end of the second conductor from the insulated composite in a connection direction, wherein an electrical conduction path is formed for at least the first and second conductors, the electrical conduction path extends away from the exposed at the one end of the first conductor via an insulation surrounding the first conductor and/or the insulated composite against the connection direction, and the electrical conduction path leads past the one end of the first conductor in an insulated manner in the connection direction, wherein the exposed at the one end of the first conductor is contacted by an electrically conductive ring abutting the exposed at the one end of the first conductor, by which the insulation surrounding the first conductor and/or the insulated composite is sealed by pressing an insulating sealing piece onto the insulation surrounding of the first conductor and/or the composite.

* * * * *